US009030362B2

(12) United States Patent
Abe

(10) Patent No.: US 9,030,362 B2
(45) Date of Patent: May 12, 2015

(54) ELECTRONIC DEVICE EQUIPPED WITH ANTENNA DEVICE AND SOLAR PANEL

(75) Inventor: Kazuaki Abe, Iruma (JP)

(73) Assignee: Casio Computer Co., Ltd, Tokyo (JP)

( * ) Notice: Subject to any disclaimer, the term of this patent is extended or adjusted under 35 U.S.C. 154(b) by 197 days.

(21) Appl. No.: 13/275,468

(22) Filed: Oct. 18, 2011

(65) Prior Publication Data

US 2012/0105288 A1 May 3, 2012

(30) Foreign Application Priority Data

Oct. 28, 2010 (JP) ..... 2010-242149

(51) Int. Cl.

| | |
|---|---|
| ***H01Q 1/12*** | (2006.01) |
| ***G04G 21/04*** | (2013.01) |
| ***G04C 10/02*** | (2006.01) |
| ***G04R 60/10*** | (2013.01) |

(52) U.S. Cl.
CPC ..... *G04G 21/04* (2013.01); *G04C 10/02* (2013.01); *G04R 60/10* (2013.01)

(58) Field of Classification Search
CPC ..... H01Q 1/273
USPC ..... 343/702, 700 MS, 718, 787
See application file for complete search history.

(56) References Cited

U.S. PATENT DOCUMENTS

| | | | | |
|---|---|---|---|---|
| 4,761,654 | A * | 8/1988 | Zaghloul | 343/700 MS |
| 8,072,844 | B2 * | 12/2011 | Miyahara | 368/47 |
| 8,482,470 | B2 * | 7/2013 | Abe | 343/718 |
| 2001/0020897 | A1 * | 9/2001 | Takatori et al. | 340/572.7 |
| 2008/0055177 | A1 * | 3/2008 | Dixon | 343/787 |
| 2011/0051561 | A1 * | 3/2011 | Fujisawa | 368/47 |

FOREIGN PATENT DOCUMENTS

| | | |
|---|---|---|
| EP | 2 177 962 A2 | 10/2009 |
| JP | 08-213819 | 8/1996 |
| JP | 2001-289970 | 10/2001 |
| JP | 2005-233900 | 9/2005 |

OTHER PUBLICATIONS

S. Vaccaro et al, Integrated Solar Panel Antennas, 2000, Electronics Letters 36, Issue 5, pp. 390-391.*

(Continued)

*Primary Examiner* — Sue A Purvis
*Assistant Examiner* — Hai Tran
(74) *Attorney, Agent, or Firm* — Amin, Turocy & Watson, LLP

(57) ABSTRACT

Disclosed is an electronic device including an antenna device which is constituted by a plate like radiator being provided on a top surface side of a plate like dielectric and a plate like grounding conductor being provided on a back surface side of the plate like dielectric, a solar panel which is arranged on a top surface side of the antenna device and a circuit board which is arranged on a back surface side of the antenna device and electrically connected with an electrode formed at an outer circumference of the solar panel, and the outer circumference of the solar panel, excluding the electrode, is formed so as not to exceed outside from an outer circumference of the radiator, and the electrode projects outside from the outer circumference of the radiator and an outer circumference of the dielectric and is electrically connected with the circuit board at outside of the dielectric.

2 Claims, 10 Drawing Sheets

(56) References Cited

OTHER PUBLICATIONS

Extended European Search Report for European Application No. 11185860.1-1240 mailed on Feb. 13, 2012.

Chinese Office Action for Chinese Patent Application No. 201110339522.0 mailed on Mar. 12, 2014.

S. Vaccaro, et al.; Integrated Solar Panel Antennas; Electronics Letters; Mar. 2, 2000; pp. 390-391; vol. 36, No. 5.

* cited by examiner

ELECTRONIC DEVICE EQUIPPED WITH ANTENNA DEVICE AND SOLAR PANEL

BACKGROUND OF THE INVENTION

1. Field of the Invention

The present invention relates to an electronic device equipped with an antenna device and a solar panel.

2. Description of Related Art

In recent years, GPS (Global Positioning System) receiving car navigation devices for vehicle and portable handy type GPS receivers have been made to be in practical use at low cost and are being widely used. Further, recently, GPS receivers and receiver modules are becoming smaller in their sizes due to developments in techniques of digital communications and mobile communications and due to components becoming shorter and smaller by using dielectric ceramics and ferroelectric materials. Further, there have been various suggestion regarding GPS receiver and position detection system for very small portable devices of wrist watch type and the others.

In such type of commercial use GPS receiver, a patch type plan antenna or a cylindrical helical which is housed in a separate case from the receiver or a match antenna embedded in a receiver case is used as a receiving antenna.

Under such circumstances, conventionally, there is known a patch antenna device having a plate like dielectric, a plate like radiator provided on the top surface side of the dielectric, a plate like grounding conductor provided on the back surface side of the dielectric and a power supply member electrically connected to the radiator arranged in a clock case of a watch, and a plate for adjusting frequency is further provided on the top surface side of the radiator via another dielectric as disclosed in JP H8-213819.

Moreover, in recent years, in view of ecology, the percentage of the clocks which use solar panel power generation is increasing, and the watches having a structure in which a solar panel is arranged on the back side of the clock glass of the clock case as shown in JP 2001-289970 are known. In such watches, the solar panel and the circuit board are electrically connected at the outer circumference of the solar panel by using an electric connection member such as a coil spring.

However, in a case where the patch antenna device and the solar panel are provided in the clock case of the watch one being on top of the other, if the outer shape of the solar panel is larger than the outer shape of the antenna device and the solar panel and the circuit board are to be electrically connected by using the electric connection member such as a coil spring at a position on the outer circumference portion of the solar panel as described in JP 2001-289970, there is a problem that the solar panel covers the entire outer circumference portion of the radiator having a strong electric field and gain reduction in the antenna is to be induced.

SUMMARY OF THE INVENTION

In view of the above problem, an object of the present invention is to provide an electric device including an antenna device and a solar panel having the configuration that inhibits the gain reduction in the antenna even in a case where the antenna device and the solar panel are both used.

According to a first aspect of the present invention, there is provided an electronic device including an antenna device which is constituted by a plate like radiator being provided on a top surface side of a plate like dielectric and a plate like grounding conductor being provided on a back surface side of the plate like dielectric, the plate like dielectric being sandwiched by the plate like radiator and the plate like grounding conductor, a solar panel which is arranged on a top surface side of the antenna device and a circuit board which is arranged on a back surface side of the antenna device and electrically connected with an electrode formed at an outer circumference of the solar panel, and the outer circumference of the solar panel, excluding the electrode, is formed so as not to exceed outside from an outer circumference of the radiator, and the electrode projects outside from the outer circumference of the radiator and an outer circumference of the dielectric and is electrically connected with the circuit board at outside of the dielectric.

According to the present invention, the outer circumference of the solar panel, excluding the electrodes, is formed so as not to exceed outside from the outer circumference of the radiator, and the electrodes project outside from the outer circumferences of the radiator and the dielectric and are electrically connected with the circuit board at outside of the dielectric. Therefore, gain reduction in the antenna can be inhibited surely even when the antenna device and the solar panel are both used.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Hereinafter, embodiments of the present invention will be described with reference to the drawings. Here, a case where the present invention is applied to a watch which is one of electronic devices is described. However, the present invention is not limited to be applied to a watch, and it is needless to say that the present invention can be applied to general electric devices equipped with antenna device and solar panel.

Figure 1:
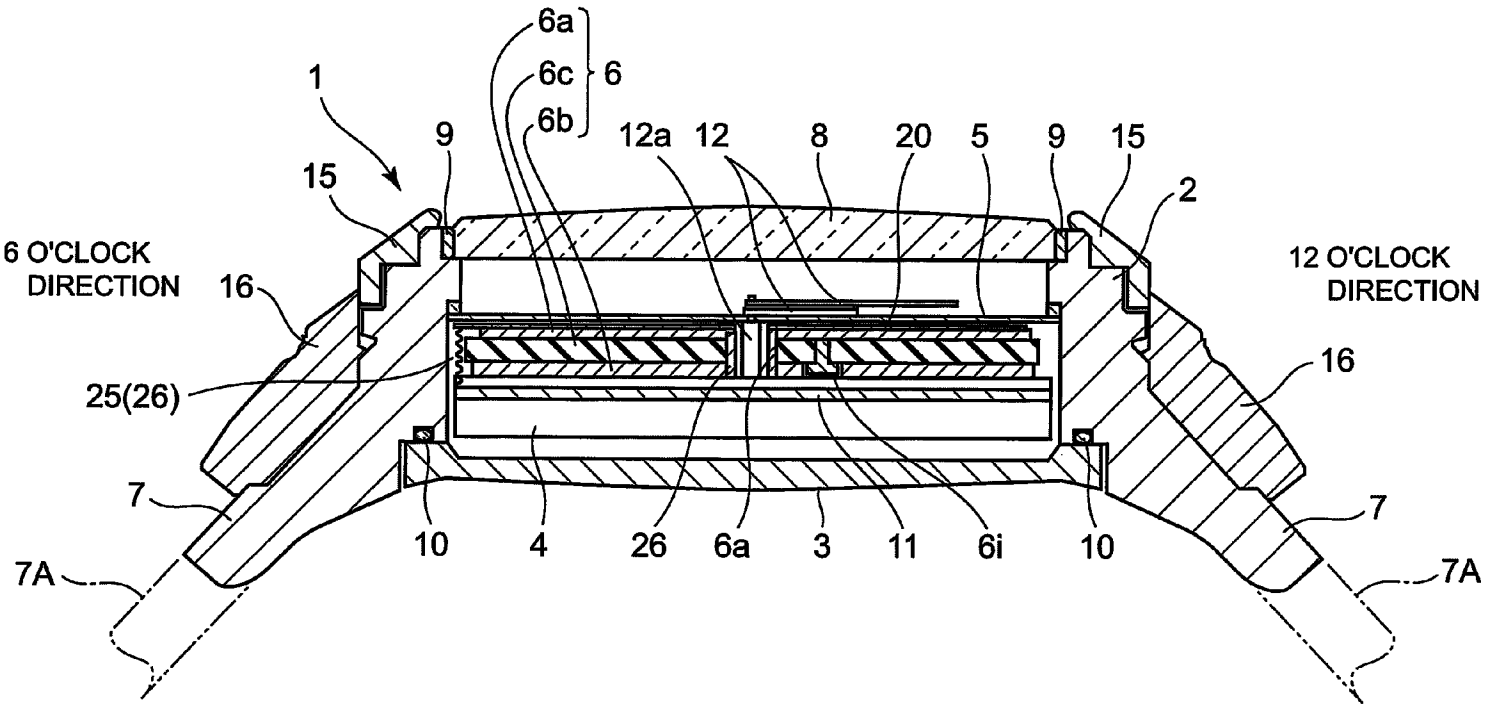
FIG. 1 is a vertical sectional view showing a watch according to an embodiment of the present invention.

FIG. 1 is an outline of a sectional view of the watch 1 according to the first embodiment.

The watch 1 includes a clock case 2 which is a cylindrical metallic case body and a back cover 3 made of a metallic material which closes the opening at the end of the clock case 2. In the clock case 2, a clock module 4 and a clock face 5 are disposed. Further, in the clock case 2, an antenna device 6 and a solar panel 20 are provided between the clock module 4 and the clock face 5.

Here, the antenna device 6 is an antenna device for receiving GPS (Global Positioning System) radio wave. On the other hand, the solar panel 20 is a solar panel for charging a secondary cell (not shown in the drawing) which is equipped in the watch 1 with electric charge generated by power generation.

Moreover, at each of the positions in 12 o'clock direction and 6 o'clock direction of the clock case 2, a band attaching section 7 for attaching a band 7A to wear the watch on a wrist is provided. Further, at the upper part of the side surface of the clock 2, a bezel 15 and a cover member 16 are provided. The bezel 15 and the cover member 16 are made from metal.

Particularly, the clock case 2 is made from metal such as stainless, titanium or the like in a cylindrical shape. At the upper end of the clock case 2, a clock glass 8 which is a transparent member that closes the opening at the upper end of the clock case 2 is fit in via a gasket 9 so that the clock face can bee seen from outside. On the other hand, at the lower end of the clock case 2, the back cover 3 made from metal similar to the metal from which the clock case 2 is formed is attached via a waterproof ring 10. The back cover 3 closes the opening at the lower end of the clock case 2.

Moreover, in the clock case 2, a circuit board 11 is disposed in addition to the clock module 4, the antenna device 6, the solar panel 20 and the clock face 5.

Although not shown in the drawing, the clock module 4 includes an IC chip in which various types of circuits and the like are formed and an analog clock hands mechanism to handle the clock hands 12 which are the hour hand and the minute hand on the clock face 5. The circuit elements formed in the IC chip include a control IC such as a CPU which controls individual parts of the clock module 4, a receiving circuit for taking out position data and time data included in GPS radio wave by receiving and amplifying/decoding the GPS radio wave wherein the receiving circuit is electrically connected to the antenna device 6 and a timing circuit having an oscillator which times the present time.

For example, the control IC controls displaying of the present position based on the position data taken out by the receiving circuit and also performs a time correction process based on the time data taken out by the receiving circuit. However, instead of obtaining time data from GPS radio wave, time data may be obtained from a standard radio wave by including a separate antenna device.

Figure 2:
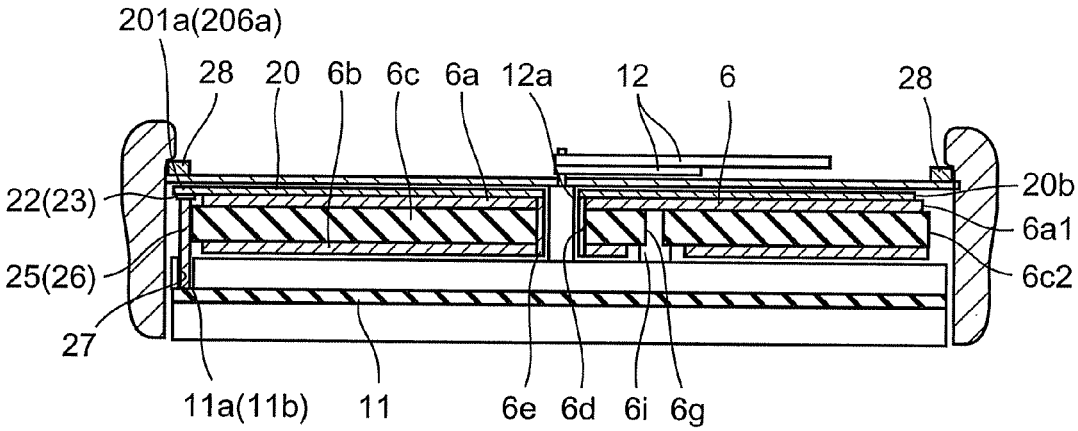
FIG. 2 is a sectional view where an antenna device, a solar panel and the surrounding thereof in the watch of FIG. 1 are enlarged.

Here, in FIGS. 1 and 2, the reference numeral 12*a* indicates the clock hand axis, and this clock hand axis 12*a* penetrates the antenna device 6, the solar panel 20 and the clock face 5 and projects from the clock face 5 and the clock hands 12 are attached to the projected portion of the clock hand axis 12*a*.

Moreover, on the upper surface of the circuit board 11, conductive patterns 11*a* and 11*b* (see FIG. 2) and the like which are to be connected to the circuits such as a power circuit, the receiving circuit and the timing circuit are formed.

Next, the antenna device 6 will be described. FIG. 2 is a sectional view in which the antenna device 6, the solar panel 20 and the clock module 4 are enlarge, FIG. 3 is a plan view of the antenna device 6 and FIG. 4 is a sectional view in which a part of the antenna device 6 is enlarged.

As shown in FIG. 2, the antenna device 6 has a planar antenna structure where a plate like dielectric 6*c* is sandwiched by plate like radiator 6*a* and ground conductor 6*b* respectively from the top and the bottom. Each of the radiator 6*a* and the grounding conductor 6*b* is constituted of a silver foil having the thickness of 12 μm, for example. On the other hand, the dielectric 6*c* is constituted by laminating thirteen layers of ceramics each having the thickness of 50 μm, for example.

In such way, in the embodiment, it is attempted to shorten the wavelength by using the dielectric 6*c* for the antenna device 6 and by raising the relative dielectric constant of the dielectric 6*c* relatively. For example, the relative dielectric constant of the dielectric 6*c* is set to about 10 to 30 when the inner diameter of the clock case 2 is about 30 mm.

Figure 3:
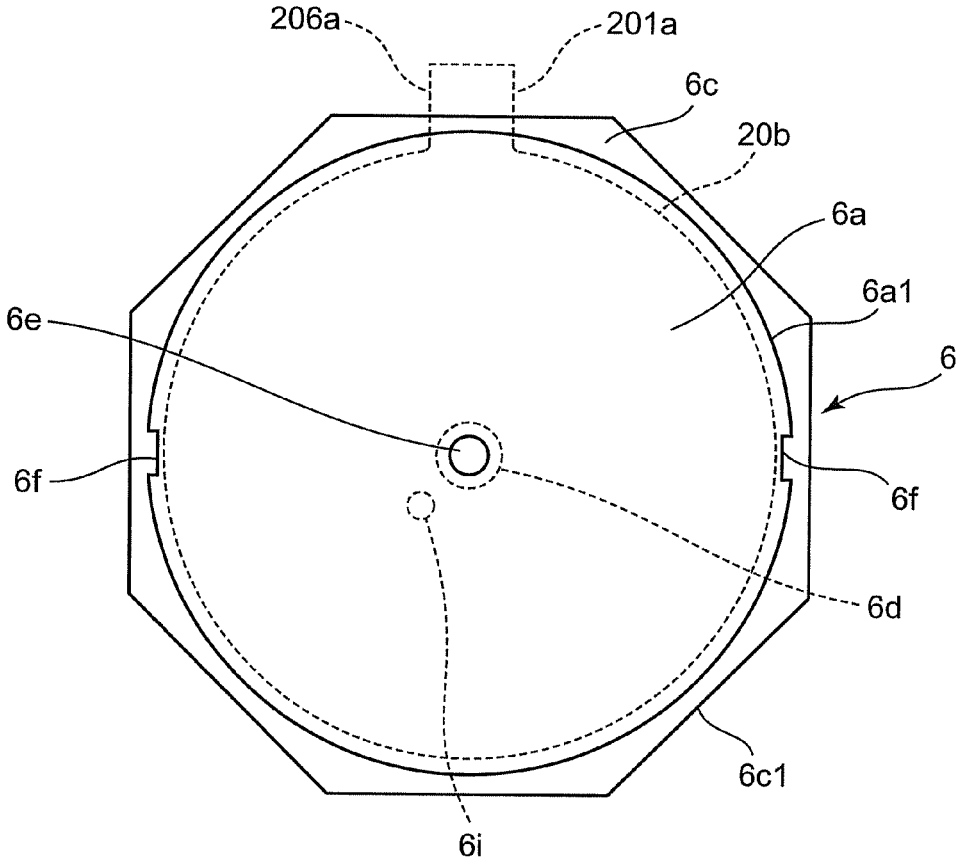
FIG. 3 is a plan view of the antenna device of FIG. 2.
Figure 4:
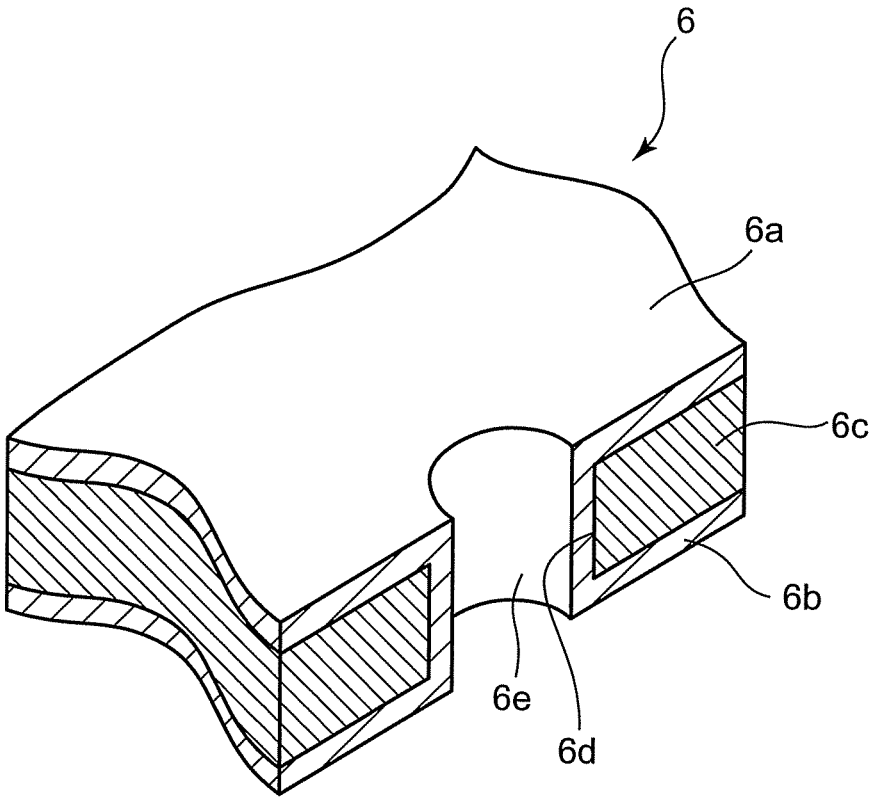
FIG. 4 is a sectional view where a part of the antenna device of FIG. 3 is enlarged.

As shown in FIGS. 2 to 4, a hole 6*d* that penetrates the centers of the radiator 6*a*, the dielectric 6*c* and the grounding conductor 6*b* at the center of the radiator 6*a*. The diameter of the hole 6*d* is 2.5 mm, for example. The radiator 6*a* and the grounding conductor 6*b* are to have electrical short circuit by a short-cut conductor 6*d* which is disposed along the entire inner wall that defines the hole 6*d*, that is, the entire inner circumference surface of the hole 6*d*.

Further, as shown in FIG. 3, at the positions on the outer circumference 6*a*1 of the radiator 6*a* that face each other by having the radiator 6*a* at the center thereof, a pair of cut-out portions 6*f* is formed. The pair of cut-out portions 6*f* is provided to make the antenna device 6 function as a circularly polarized antenna.

Moreover, as shown in FIG. 2, a hole 6*g* is formed in the grounding conductor 6*b*. In the hole 6*g*, a power supply pin 6*i* which is a power supply member having a power supply land is provided. The power supply pin 6*i* is electrically connected with the radiator 6*a*. Further, the power supply pin 6*i* is electrically connected to the receiving circuit via the power supply land (not shown in the drawing). Here, the grounding conductor 6*b* is grounded via a conductive patter (not shown in the drawing) formed on the circuit board 11 at a position not shown in the drawing.

In the embodiment, the dielectric 6*c* of the antenna device 6 is formed in an octagon shape. In such way, by forming the dielectric 6*c* in an octagon shape, the corners thereof act as positioning units when assembling the clock case 2 of the watch 1 and assembling other devices in the case and the antenna device 6 can be prevented from rotating. Also, the corners function as indicators when assembling the antenna device 6 in the case, and the orientation of the antenna can be matched easily. Here, shape of the dielectric 6*c* of the antenna device 6 is not limited to the octagon shape, and can be other shapes such as polygonal shapes and round shapes.

Figure 5:
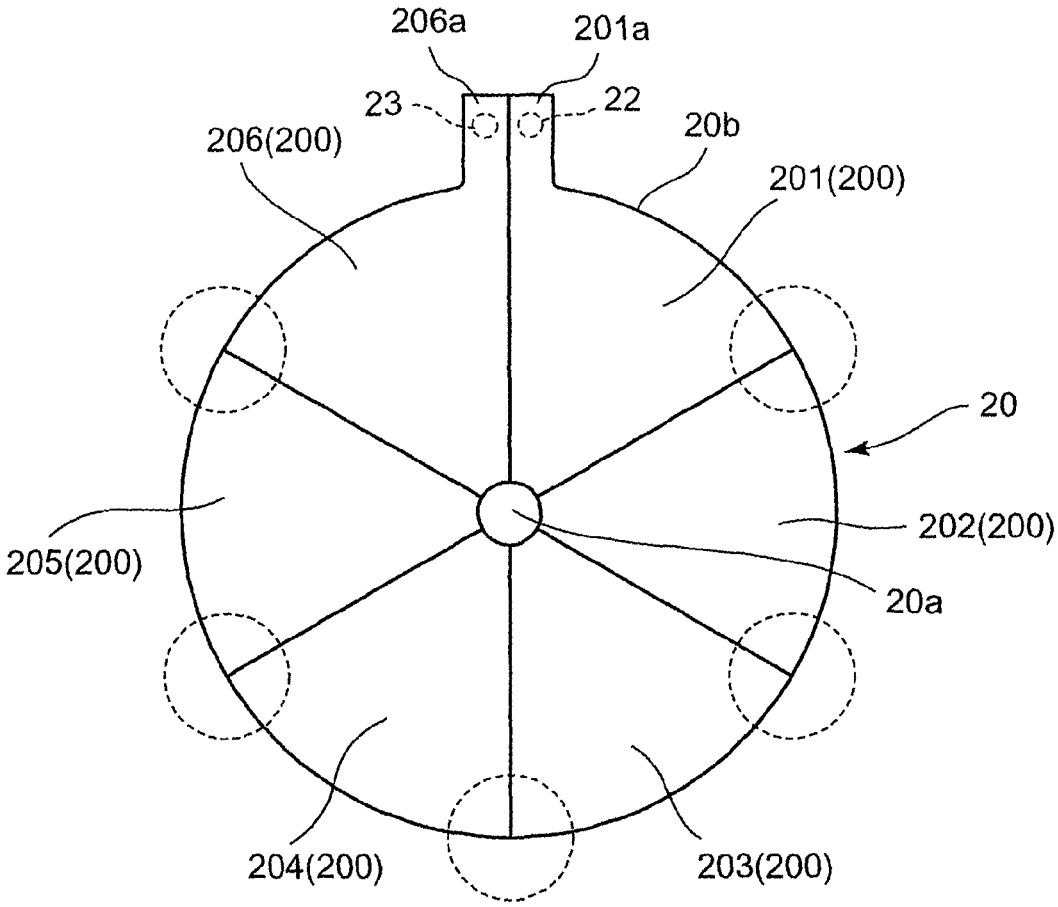
FIG. 5 is a plan view of the solar panel of FIG. 3.

Next, the solar panel 20 will be described. FIG. 5 is a plan view of the solar panel 20.

The solar panel 20 is constituted of six plate like cells 200. However, it is needless to say that the number of cells 200 is not limited to six. In the following description, reference numerals 201 to 206 are used instead of the reference numeral 200 when describing the six cells 200 separately for convenience of description.

Each of the six cells 200 is formed in a fan shape in a plan view. Particularly, each of the six cells 200 has two straight sides forming the central angle of 60°, one side which is concaved in an arc shape that connects the ends of the two straight sides that come close to each other and one side which convexes in an arc shape that connects the other ends of the two straight lines that be apart from each other. By the six cells 200 being planarly arranged side by side, the solar panel 20 in an overall round shape having a hole 20*a* at the center position is structure. In this case, the sides which convex in arc shape of the six cells 200 are connected in a loop shape without overlapping with each other to form the circular outer edge of the solar panel 20. Further, the sides which are concaved in arc shape of the six cells 200 are connected in a loop shape without overlapping with each other to form the hole 20*a* at the center of the solar panel 20.

In the solar panel 20, the cells 201 to 206 are connected serially in this order. That is, the cells 201 and 202, the cells 202 and 203, the cells 203 and 204, the cells 204 and 205 and the cells 205 and 206 are electrically connected by electric connections 21 at the outer circumference portion of the solar panel 20.

Figure 6:
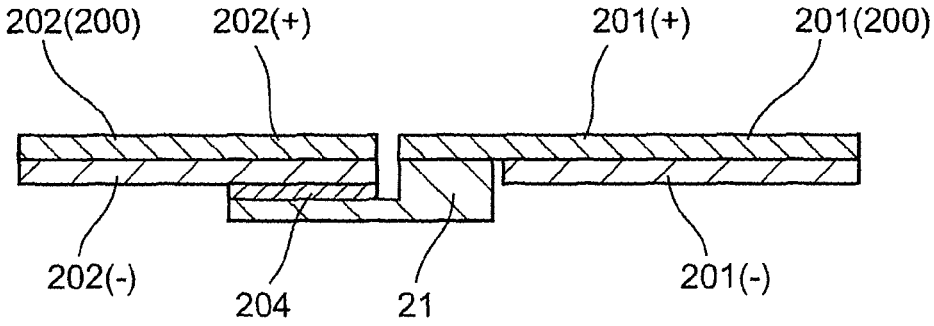
FIG. 6 is a sectional view showing an electric connection structure of panels of the solar panel of FIG. 5.

FIG. 6 shows the electrical connection structure of the solar panel 20. The connection structure is provided at each of the dotted circles of FIG. 5, that is, at each border portion of the adjacent cells on the outer circumference portion of the solar panel 20. Hereinafter, the connection structure will be described by taking the connection structure between the cells 201 and 202 as an example.

Each of the cell 201 and the cell 202 has a structure wherein a positive pole which is the front side and a negative pole which is the back side being layered on top of each other. Here, when the plus pole of the cell 201 is indicated as 201 (+) and the minus pole of the cell 201 is indicated as 201 (−) and when the plus pole of the cell 202 is indicated as 202 (+) and the minus pole of the cell 202 is indicated as 202 (−), a part of the minus pole 201 (−) of the cell 201 is cut off and one end portion of the electric connection 21 is electrically connected with the plus pole 201 (+) of the cell 201 at the cut-off portion. Then, the other end portion of the electric connection 21 is pulled to the back side of the cell 202, and the other end portion of the electric connection 21 is connected with the minus pole 202 (−). Here, the reference numeral 24 in FIG. 6 indicates a conductive adhesive agent.

By the similar connection structure, the cells 202 and 203, the cells 203 and 204, the cells 204 and 205 and the cells 205 and 206 are electrically connected to each other.

Figure 7:
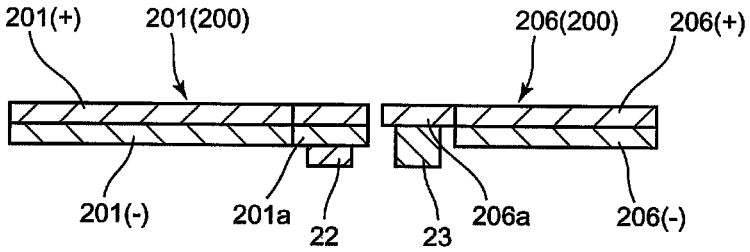
FIG. 7 is a sectional view showing a structure of electrode pads of the solar panel of FIG. 5.

Next, the structure of the electrode pad 22 provided at the cell 201 and the structure of the electrode pad 23 provided at the cell 206 will be described. FIG. 7 is a sectional view showing the structure of the electrode pad 22 and the electrode pad 23.

In the cell 201, an electrode 201*a* which projects outward than the rest is formed. The electrode 201*a* is formed of parts of the plus pole 201 (+) and minus pole 201 (−) of the cell 201 and the electrode pad 22 which is electrically connected to the minus pole 201 (−).

On the other hand, in the cell 206, an electrode 206*a* which projects outward than the rest is formed. The electrode 206*a* is formed of a part of the plus pole 206 (+) of the cell 206 and the electrode pad 23 which is electrically connected to the plus pole 206 (+).

Figure 8:
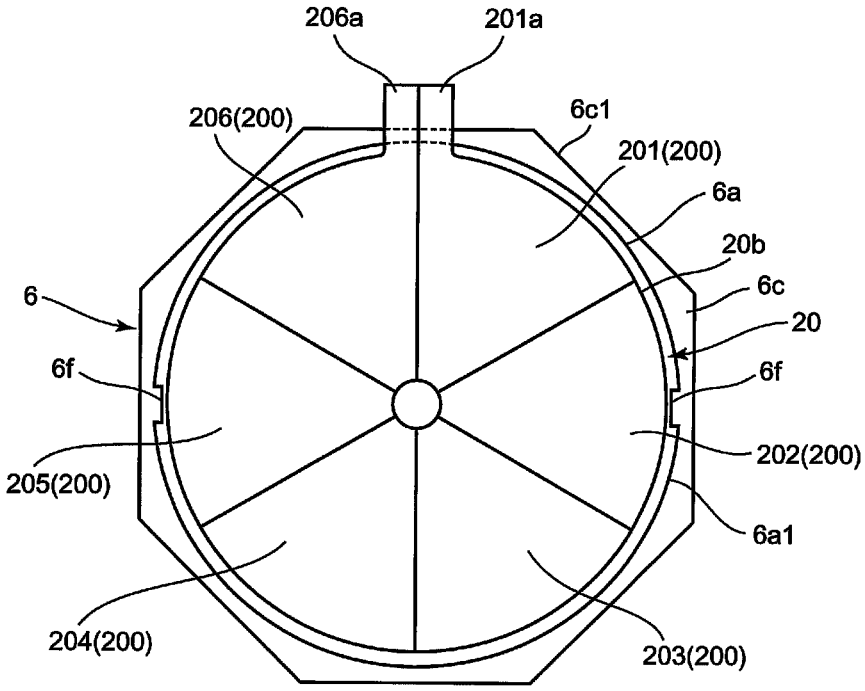
FIG. 8 is a plan view of the antenna device on which the solar panel is disposed.

The solar panel 20 which is structured as described above is disposed on the antenna device 6. FIG. 8 is a plan view of the antenna device 6 on which the solar panel 20 is disposed.

The overall size of the solar panel, excluding the electrodes 201*a* and 206*a*, is same or smaller than the overall size of the radiator 6*a* of the antenna device 6. Further, the outer circumference of the solar panel 20, excluding the electrodes 201*a* and 206*a*, does no exceed outside from the outer circumference 6*a*1 of the radiator 6*a* of the antenna device 6 in a state where the solar panel 20 is disposed on the antenna device 6. On the other hand, the electrodes 201*a* and 206*a* which are formed at the outer circumference of the solar panel 20 stick out from the outer circumference 6*c*1 of the dielectric 6*c* of the antenna device 6 in a state where the solar panel 20 is disposed on the antenna device 6. With portions of the electrodes 201*a* and 206*a* that stick out from the outer circumference 6*c*1 of the dielectric 6*c* of the antenna device 6, the solar panel 20 and the circuit board 11 are electrically connected.

Here, when the cut-out portions 6*f* need to be provided in the radiator 6*a* of the antenna device 6 as described above to make the antenna device 6 function as a circularly polarized antenna, the sides of the cut-out portions 6*f*, which are the bottoms of the cut-out portions 6*f*, in the radius direction also form parts of the outer circumference 20*b* of the radiator 6*a*. Therefore, cut-out portions need to be formed in the solar panel 20 also at the positions corresponding to the cut-out portions 6*f* or the diameter of the solar panel 20 needs to be smaller than the diameter corresponding to the positions where the cut-out portions 6*f* are formed so that the outer circumference 20*b* of the solar panel 20 will not exceed outside than the sides which are the bottoms of the cut-out portions 6*f*.

FIG. 2 shows the electric connection structure of the solar panel 20 and the circuit board 11.

On the circuit board 11, the conductive patterns 11*a* and 11*b* are formed at the positions corresponding to the electrode pads 22 and 23. The conductive patterns 11*a* and 11*b* are formed at the positions exceeding outside from the outer circumference 6*c*1 of the dielectric 6*c* of the antenna device 6. Further, the electrode pads 22 and 23 and the conductive patterns 11*a* and 11*b* are respectively electrically connected in one to one manner by the cold spring like electric connection members 25 and 26, respectively. In such case, although it is not specifically limited, the lower end portions of the electric connection members 25 and 26 are inserted in the guide hole 27 formed in the clock module 4. Further, a pressing ring 28 is provided on the clock face 5 and the solar panel 20 and the clock face 5 can be prevented from being lifted up due to the biasing force of the electric connection members 25 and 26 by the pressing ring 28.

Here, in the drawing, the electrode pads 22 and 23 are indicating one member for the convenience of drawing. However, it is obvious that the electrode pads 22 and 23 are different members. Moreover, the same applies to the electric connection members 25 and 26, the conductive patterns 11*a* and 11*b* and the electrodes 201*a* and 206*a* which correspond to the electrode pads 22 and 23.

Figure 9A:
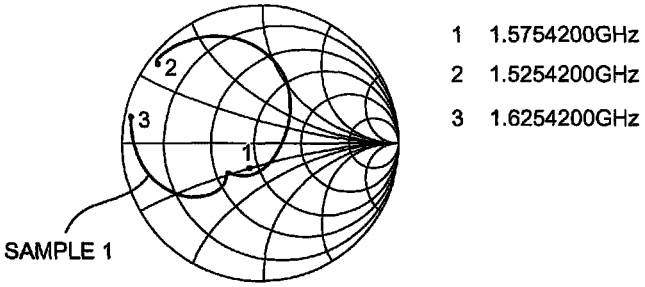
FIGS. 9A, 9B and 9C show characteristics of antenna devices, FIG. 9A being the smith chart showing the characteristic of the antenna device which does not have solar panel (sample 1), FIG. 9B being the smith chart showing the characteristic of the antenna device having the solar panel of similar structure as that of embodiment 1 (sample 2) and FIG. 9C being the smith chart showing the characteristic of the antenna device having the solar panel which is larger than the dielectric (sample 3)
Figure 9B:
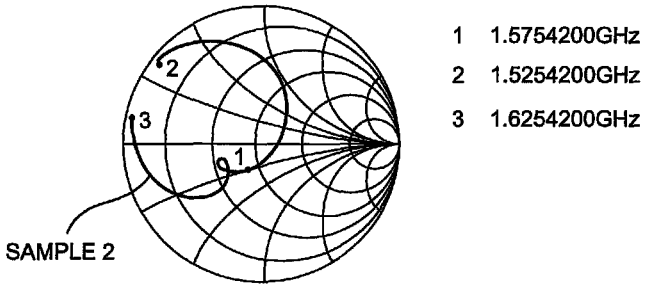
Figure 9C:
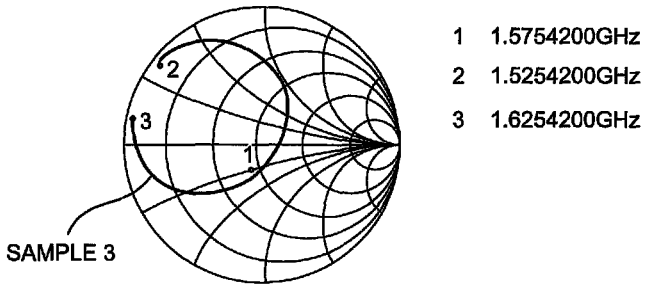

FIGS. 9A to 9C are smith charts showing characteristics of various kinds of samples including the structure of the embodiment.

FIG. 9A is the smith chart showing the characteristic of the antenna device 6 which does not have solar panel (sample 1), FIG. 9B is the smith chart showing the characteristic of the antenna device 6 having solar panel wherein the outer circumference of the solar panel 20 excluding the electrodes 201*a* and 206*a* is smaller than the outer circumference of the radiator 6*a* so that the solar panel 20 does not exceed outside from the outer circumference of the radiator 6*a* (sample 2), and FIG. 9C is the smith chart showing the characteristic of the antenna device 6 having solar panel wherein the outer circumference of the solar panel 20 exceeds outside from the outer circumference of the dielectric 6*c* (sample 3).

Here, as for the antenna device 6 of samples 1 to 3, the antenna device similar to that in the embodiment is used. Further, as for the solar panels 20 of samples 2 and 3, the solar panels each having a hole in the center similarly as in the embodiment are used.

From FIGS. 9A to 9C, according to sample 2 having the configuration in which the outer circumference of the solar panel 20 does not exceed outside from the outer circumference of the radiator 6*a*, a constricted part is formed because the antenna has the circularly polarization characteristic, similarly as in sample 1 which does not have solar panel, and at this constricted part, the impedances are matched at the center frequency (1.57542 GHz).

On the other hand, there is almost no constricted part in the antenna device 6 in which the outer circumference of the solar panel 20 exceeds outside from the outer circumference of the dielectric 6*c* (sample 3), showing linearly polarized wave.

From the above, it is understood that having the configuration in which the outer circumference of the solar panel 20 does not exceed outside from the outer circumference of the radiator 6*a* is advantageous for realizing an antenna device having an excellent circularly polarization characteristic and in which impedances are matched at the center frequency.

Figure 10:
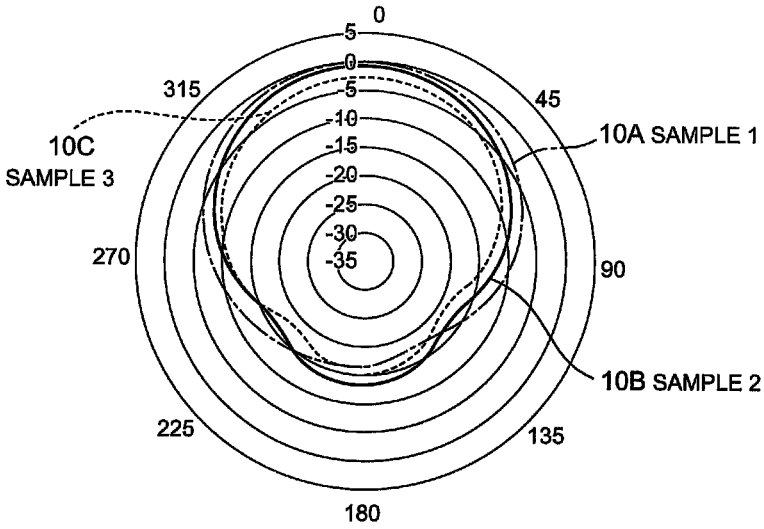
FIG. 10 shows directional gain characteristics of the antenna device which does not have solar panel (sample 1), the antenna device having the solar panel of similar structure as that of embodiment 1 (sample 2) and the antenna device having the solar panel which is larger than the dielectric (sample 3), when the antenna devices receive right-hand circularly polarized wave.

FIG. 10 shows directional gain characteristics at the time when receiving the right-hand circularly polarized wave in the cases where the above samples 1 to 3 are arranged in the metallic clock cases 8. In the drawing, the numbers on the outer circumference of the circles show the angles (unit: degrees (°)) indicating directions when the direction of the apex (direction in the clock glass 8 side) of the patch antenna device is set to 0°, and the radius direction of the circles indicate the gain (unit: dB).

In the same drawing, the directional gain characteristic curve 10A shown in double dashed line is the directional gain characteristic curve when the input impedance of the antenna device 6 of sample 1 is measured. Further, the directional gain characteristic curve 10B shown in solid line is the direction gain characteristic curve when the input impedance of sample 2 is measured. Furthermore, the directional gain characteristic curve 10C shown in dashed line is the directional gain characteristic curve when the input impedance of sample 3 is measured.

Here, with respect to the above directional gain characteristic curves, the maximum gain 0 dB when the input impedance of sample 1 which does not have the solar panel 20 is not provided on the antenna device 6 is measured is the standard.

The following can be understood from FIG. 10.

That is, gain is reduced for 2.8 dB in sample 3 having the configuration in which the outer circumference of the solar panel 20 does not exceed outside from the outer circumference of the dielectric 6*c* comparing to sample 1 which does not have solar panel.

On the other hand, the gain is also reduced for 0.9 dB in sample 2 having the configuration in which the outer circumference of the solar panel 20 exceeds outside from the outer circumference of the radiator 6*a*, similarly to the embodiment, comparing to sample 1 which does not have solar panel. However, the gain is recovered for 1.9 dB comparing to sample 3.

From the above, it is understood that having the configuration in which the outer circumference of the solar panel 20 does not exceed outside from the outer circumference of the radiator 6*a* is advantageous for improving the gain in the antenna.

It is obvious from the above description that the following advantages can be obtained according to the embodiment.

That is, according to the embodiment, because the solar panel 20 having the electrodes 201*a* and 206*a* formed at the outer circumference thereof is provided on the antenna device 6 and the outer circumference 20*b* of the solar panel 20, excluding the electrodes 201*a* and 206*a*, does not exceed outside from the outer circumference 6*a*1 of the radiator 6*a*, the antenna gain can be improved comparing to the prior techniques.

Here, such result is assumed to be obtained even when the overall size of the solar panel 20, excluding the electrodes 201*a* and 206*a*, is formed to be same size as the overall size of the radiator 6*a*. The gain reduction in antenna occurs due to the solar panel 20 covering the entire outer circumference of the radiator 6*a* having a strong electric field and the metal in the solar panel 20 which exceeded outside from the outer circumference of the radiator 6*a* also becoming the radiation source affecting the antenna characteristic. Therefore, in the configuration where the outer circumference of the radiator 6*a* having a strong electric field is not covered by the solar panel 20 as much as possible, it is assumed that the gain reduction in antenna can be inhibited.

Figure 11:
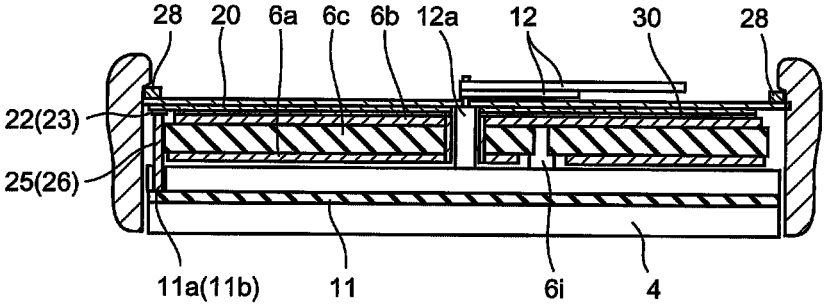
FIG. 11 is a sectional view where an antenna device, a solar panel and the surrounding thereof in a watch according to the second embodiment of the present invention are enlarged.

Next, the watch 100 of the second embodiment will be described. FIG. 11 is an outline of vertical sectional view of the watch 100 of the second embodiment.

The watch 100 differs from the watch 1 of the first embodiment in that an insulating double sided adhesive tape 30 is attached between the cell 200 and the antenna device 6. Other than the above, the configuration of the watch 100 is completely the same as the configuration of the watch 1, thus, drawings and descriptions are arbitrarily omitted.

Figure 12:
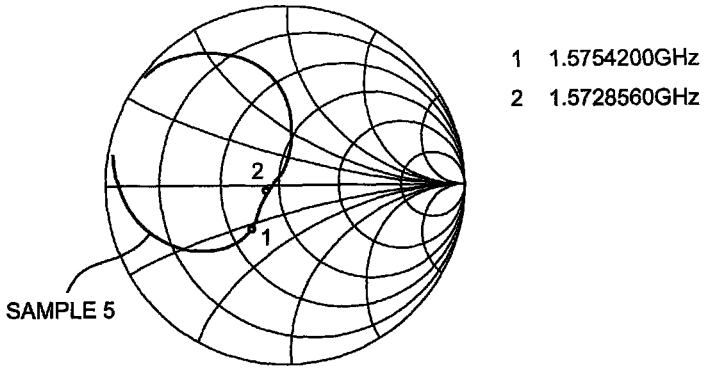
FIG. 12 shows the characteristic of a sample which does not have a metallic case and is the smith chart showing the characteristic of the antenna device in which insulating double sided adhesive tape is intervened between the antenna device and the solar panel similarly as in the second embodiment (sample 5)

FIG. 12 is the smith chart showing the characteristic of various types of samples without metallic cases.

FIG. 12 is the smith chart showing the characteristic of the antenna device 6 in which the insulating double sided adhesive tape 30 is intervened between the solar panel 20 and the antenna device 6 (sample 5).

Here, as for the antenna device 6 of sample 5, the antenna device similar to that in the first embodiment is used. Further, as for the solar panel 20 of sample 5, the conventional solar panel 20 which is slightly larger than the radiator 6*a* of the antenna device 6 having a hole in the center is used.

The following can be understood from FIG. 12.

That is, according to sample 5 having the configuration in which an insulating double sided adhesive tape 30 is intervened between the solar panel 20 and the antenna device 6, there is a constricted part similarly to sample 1 which does not have solar panel because sample 5 is the antenna having the circularly polarization characteristic. Further, in samples, at the constricted part, impedances are matched at the frequency (1.5728560 GHz).

On the other hand, according to sample 3 having the configuration in which the insulating double sided adhesive tape 30 is not intervened between the solar panel 20 and the antenna device 6, there is almost no constricted part in FIG. 9C showing linearly polarized wave.

From the above, it is shown that when the antenna device 6 has the configuration in which the insulating double sided adhesive tape 30 is intervened between the solar panel 20 and the antenna device 6, it is advantageous for realizing an antenna device having an excellent circularly polarization characteristic and in which impedances are matched at the center frequency.

Figure 13:
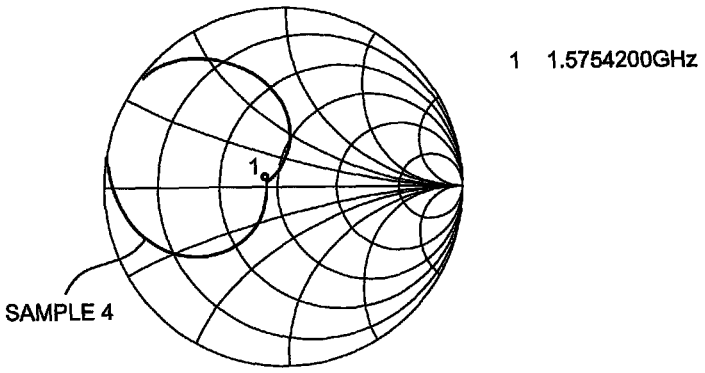
FIG. 13 shows the characteristic of a sample which has a metal case, and is the smith chart showing the characteristic of the antenna device in which insulating double sided adhesive tape is intervened between the antenna device and the solar panel similarly as in the second embodiment (sample 4)

Moreover, FIG. 13 is the smith chart of the case where the antenna device 6 in which the insulating double sided adhesive tape 30 is intervened between the solar panel 20 and the antenna device 6 (sample 4) is arranged in the metallic clock case 8.

Here, as for the antenna device 6 of sample 4, the antenna device similar to that in the first embodiment is used. Further, as for the solar panel 20 of sample 4, a solar panel which is smaller than the radiator 6*a* of the antenna device 6 and has a hole in the center thereof similarly to the first embodiment is used.

Looking at the smith chart of FIG. 13, it is understood that the characteristic of sample 4 having the configuration in which the insulating double sided adhesive tape 30 is intervened between the solar panel 20 and the antenna device 6 does not change much from the characteristic of sample 1 which does not have solar panel and without metallic case shown in FIG. 9A even when sample 4 is arranged in the clock case.

Figure 14:
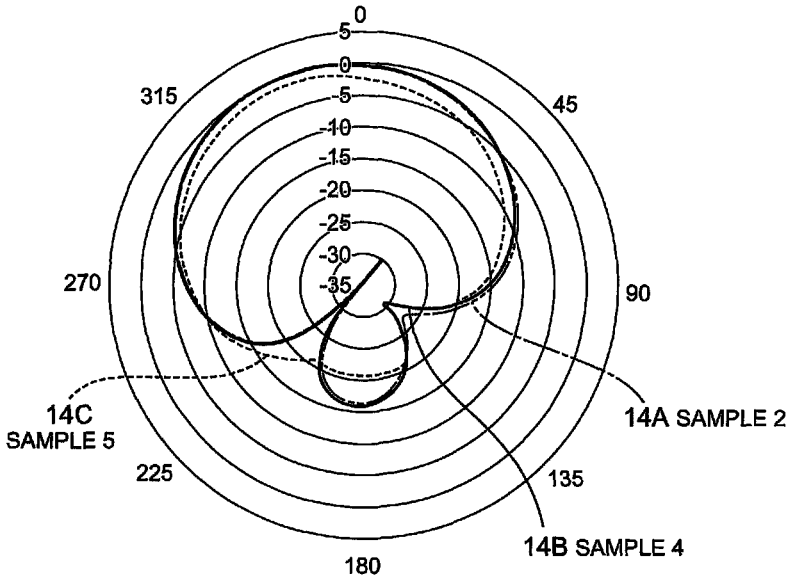
FIG. 14 shows directional gain characteristics of the antenna device which does not have solar panel (sample 1), the antenna device in which insulating double sided adhesive tape is intervened between the antenna device and the solar panel and the solar panel is smaller than a radiator of the antenna device (sample 4) and the antenna device in which insulating double sided adhesive tape is intervened between the antenna device and the solar panel and the solar panel is larger than the radiator of the antenna device (sample 5), when the antenna devices receive right-hand circularly polarized wave.

FIG. 14 shows directional gain characteristics of the antenna device 6 which does not have solar panel (the above sample 1), the antenna device 6 in which the solar panel 20 is smaller than the radiator 6*a* of the antenna device 6 and the insulating double sided adhesive tape 30 is intervened between the solar panel 20 and the antenna device 6 (the above sample 4) and the antenna device 6 in which the solar panel 20 is larger than the radiator 6*a* of the antenna device 6 and the insulating double sided adhesive tape 30 is intervened between the solar panel 20 and the antenna device 6 (sample 5) wherein the antenna devices 6 of samples 1, 4 and 5 are arranged in metallic clock cases 8, when receiving right-hand circularly polarized wave.

In the drawing, the numbers on the outer circumference of the circles show the angles (unit: degrees (°)) indicating directions when the direction of the apex (direction in the clock glass 8 side) of the patch antenna device is set to 0°, and the radius direction of the circles indicate the gain (unit: dB). The characteristic curves 14*a*, 14B and 14C show radiation characteristics of the radiators 6*a* and the like, that is, directional characteristics of gains.

In the drawing, the directional gain characteristic curve 14A shown in double dashed line is the directional gain characteristic curve when the input impedance of the antenna device 6 of sample 1 is measured. Further, the directional gain characteristic curve 14B shown in solid line is the directional gain characteristic curve when the input impedance of sample 4 is measured. Furthermore, the directional gain characteristic curve 14C shown in dashed line is the directional gain characteristic curve when the input impedance of sample 5 is measured. Here, with respect to the above directional gain characteristic curves, the maximum gain −5 dB when the input impedance of sample 1 in which the solar panel 20 is not provided on the antenna device 6 is measured is the standard.

The followings can be understood from FIG. 14.

That is, according to the antenna device 6 in which the solar panel 20 is smaller than the radiator 6*a* of the antenna device 6 and the insulating double sided adhesive tape 30 is intervened between the solar panel 20 and the antenna device 6 (sample 4), similarly to sample 1, the antenna device 6 of sample 4 has the circularly polarization characteristic having directionality in the side of clock face (in the upper direction in FIG. 14), and gain reduction due to the influence of the solar panel 20 is small and the characteristic very close to the case of the antenna device 6 which does not have solar panel (sample 1) can be obtained in the side of clock face.

On the other hand, according to sample 5 in which the solar panel 20 is larger than the radiator 6*a* of the antenna device 6 and the insulating double sided adhesive tape 30 is intervened between the solar panel 20 and the antenna device 6, the gain reduction due to the influence of the solar panel is greater comparing to sample 4 in which the solar panel is smaller than the radiator 6*a* of the antenna device 6 and the insulating double sided adhesive tape 30 is intervened between the solar panel 20 and the antenna device 6. In particular, the gain reduction in sample 5 is 1.8 dB.

From the above, making the insulating double sided adhesive tape 30 be intervened between the solar panel 20 and the antenna device 6 is effective in improving the gain in the antenna. In particular, making the solar panel 20 be smaller than the radiator 6*a* of the antenna device 6 and making the insulating double sided adhesive tape 30 be intervened between the solar panel 20 and the antenna device 6 is effective in improving the gain in the antenna.

As it is clear from the above description, the following advantages can be obtained from the embodiment.

That is, according to the embodiment, because the insulating double sided adhesive tape 30 is intervened between the solar panel 20 and the antenna device 6, the antenna characteristic similar to the antenna characteristic of the antenna device 6 which does not have solar panel can be obtained. Here, such advantage can be also obtained when any of other insulators other than insulating adhesives is intervened between the solar panel 20 and the antenna device 6 instead of the insulating double sided adhesive tape 30. In the above, the insulating double sided adhesive tape 30 having the thickness of 0.15 mm is used. However, in an experiment afterwards, it was found out that the effect is greater when the thickness of the insulator be thicker.

In view of the advantages which can be obtained in the first embodiment, when the antenna device 6 is configured by making the insulating double sided adhesive tape 30 intervene between the solar panel 20 and the antenna device 6 and making the overall size of the solar panel 20, excluding the electrodes 201*a* and 206*a*, be the same size as the overall size of the radiator 6*a* or be smaller than the overall size of the radiator 6*a* so that the outer circumference 20*b* of the solar panel 20 does not exceed outside from the outer circumference 6*a*1 of the radiator 6*a*, the antenna characteristic will be improved even more.

As it is clear from the above description, the electronic device according to the embodiments includes an antenna device (6) which is constituted by a plate like radiator (6*b*) being provided on a top surface side of a plate like dielectric (6*c*) and a plate like grounding conductor (6*a*) being provided on a back surface side of the plate like dielectric, the plate like dielectric being sandwiched by the plate like radiator and the plate like grounding conductor, a solar panel (20) which is arranged on a top surface side of the antenna device and a circuit board (11) which is arranged on a back surface side of the antenna device and electrically connected with an electrode (201*a*, 206*a*) formed at an outer circumference of the solar panel, and the outer circumference (20*b*) of the solar panel, excluding the electrode, is formed so as not to exceed outside from an outer circumference (6*a*1) of the radiator, and the electrode projects outside from the outer circumference of the radiator and an outer circumference of the dielectric and is electrically connected with the circuit board at outside of the dielectric.

Further, the electronic device according to the embodiments include an antenna device (6) which is constituted by a plate like radiator (6*b*) being provided on a top surface side of a plate like dielectric (6*c*) and a plate like grounding conductor (6*a*) being provided on a back surface side of the plate like dielectric, the plate like dielectric being sandwiched by the plate like radiator and the plate like grounding conductor, a solar panel (20) which is arranged on a top surface side of the antenna device and a circuit board (11) which is arranged on a back surface side of the antenna device and electrically connected with an electrode (201*a*, 206*a*) formed at an outer circumference of the solar panel, and the outer circumference (20*b*) of the solar panel, excluding the electrode, is formed so as not to exceed outside from an outer circumference (6*a*1) of the radiator, and an insulator (30) is intervened between the solar panel and the radiator.

Furthermore, the electronic device according to the embodiment include an antenna device (6) which is constituted by a plate like radiator (6*b*) being provided on a top surface side of a plate like dielectric (6*c*) and a plate like grounding conductor (6*a*) being provided on a back surface side of the plate like dielectric, the plate like dielectric being sandwiched by the plate like radiator and the plate like grounding conductor, a solar panel (20) which is arranged on a top surface side of the antenna device and a circuit board (11) which is arranged on a back surface side of the antenna device and electrically connected with an electrode (201*a*, 206*a*) formed at an outer circumference of the solar panel, and the outer circumference (20*b*) of the solar panel, excluding the electrode, is formed so as not to exceed outside from an outer circumference (6*a*1) of the radiator, the electrode projects outside from the outer circumference of the radiator and an outer circumference of the dielectric and is electrically connected with the circuit board at outside of the dielectric, and an insulator (30) is intervened between the solar panel and the radiator.

In the above electronic devices according to the embodiments of a cut-out portion (6*f*) is formed at the outer circumference of the radiator (6*c*) and the outer circumference of the solar panel does not exceed outside from a side of the cut-out portion which forms a bottom of the cut-out portion.

In the above, the embodiments of the present invention are described. However, the present invention is not limited to the embodiments and modifications, and the present invention can be changed in various ways.

Figure 15:
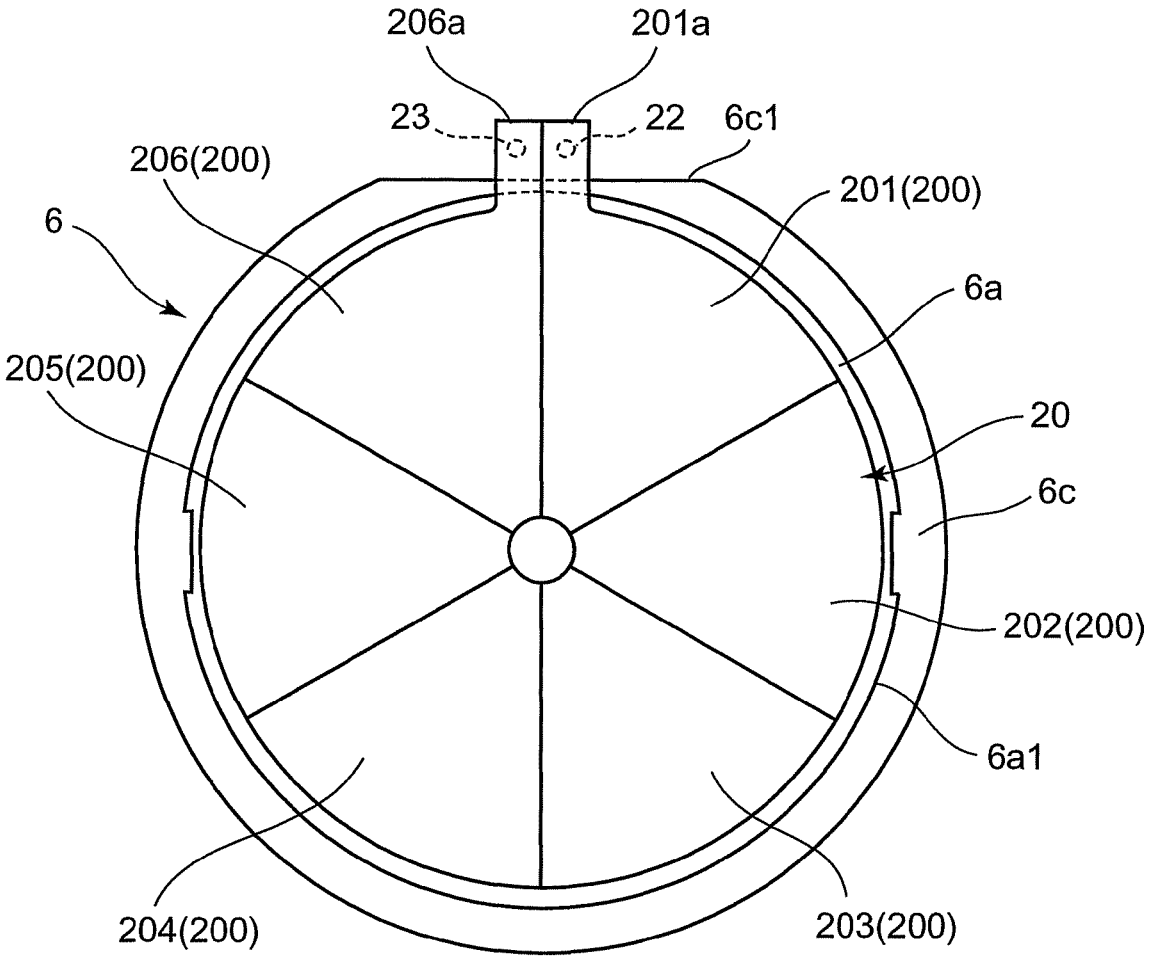
FIG. 15 is a plan view of an antenna device and the surrounding thereof of a modification example of the antenna device.

For example, in the above embodiments, an example in which the dielectric 6*c* is formed in an octagon shape is described. However, as shown in FIG. 15, the dielectric 6*c* can be a circular shape in which apart thereof is cut off in a plan view and the electrodes 201*a* and 206*a* can be provided at the cut off portion.

Moreover, the solar panel 20 has a circular shape. However, the solar panel 20 can be in an oval shape or polygon shapes.

Further, the electrodes 201*a* and 206*a* do not need to be arranged side by side, and the electrodes 201*a* and 206*a* can be provided at arbitrary two places at the outer circumference portion of the solar panel 20.

Furthermore, in the above embodiments, a case of the watch equipped with GPS receiving function is described. However, the present invention can be applied to other radio receivers such as mobile phones, GPS receivers and the like other than watches equipped with GPS receiving function.

Moreover, in the above embodiments, the case where radio wave is received is described. However, the present invention is not limited to receiving radio wave and can be also applied to cases of transmitting radio wave.

The present U.S. patent application claims a priority under the Paris Convention of Japanese paten application No. 2010-242149 filed on Oct. 28, 2010, which shall be a basis of correction of an incorrect translation.

Although various exemplary embodiments have been shown and described, the invention is not limited to the embodiments shown. Therefore, the scope of the invention is intended to be limited solely by the scope of the claims that follow.

What is claimed is:

1. An electronic device, comprising:

an antenna device which is constituted by a plate like radiator being provided on a top surface side of a plate like dielectric and a plate like grounding conductor being provided on a back surface side of the plate like dielectric, the plate like dielectric being sandwiched by the plate like radiator and the plate like grounding conductor;

a solar panel which is arranged on a top surface side of the antenna device; and a circuit board which is arranged on a back surface side of the antenna device and electrically connected with an electrode formed at an outer circumference of the solar panel;

wherein the outer circumference of the solar panel, excluding the electrode, is formed at an inner side than an outer circumference of the radiator, the electrode projects, at a predetermined position excluding a cut-out portion of the radiator, outside from the outer circumference of the radiator and an outer circumference of the dielectric and is electrically connected with the circuit board at outside of the dielectric, and the cut-out portion is formed at the outer circumference of the radiator and the outer circumference of the solar panel is formed at an inner side than a side of the cut-out portion which forms a bottom of the cut-out portion.

2. An electronic device, comprising:

an antenna device which is constituted by a plate like radiator being provided on a top surface side of a plate like dielectric and a plate like grounding conductor being provided on a back surface side of the plate like dielectric, the plate like dielectric being sandwiched by the plate like radiator and the plate like grounding conductor;

a solar panel which is arranged on a top surface side of the antenna device; and a circuit board which is arranged on a back surface side of the antenna device and electrically connected with an electrode formed at an outer circumference of the solar panel;

wherein the outer circumference of the solar panel, excluding the electrode, is formed at an inner side than the outer circumference of the radiator, the electrode projects, at a predetermined position excluding a cut-out portion of the radiator, outside from the outer circumference of the radiator and an outer circumference of the dielectric and is electrically connected with the circuit board at outside of the dielectric, an insulator is intervened between the solar panel and the radiator, and the cut-out portion is formed at the outer circumference of the radiator and the outer circumference of the solar panel is formed at an inner side than a side of the cut-out portion which forms a bottom of the cut-out portion.

* * * * *